US005151049A

United States Patent [19]

Mosquera

[11] Patent Number: 5,151,049

[45] Date of Patent: Sep. 29, 1992

[54] CONNECTOR LATCHING ARRANGEMENT

[75] Inventor: Rene A. Mosquera, Laguna Niguel, Calif.

[73] Assignee: ITT Corporation, Secaucus, N.J.

[21] Appl. No.: 728,410

[22] Filed: Jul. 11, 1991

[51] Int. Cl.[5] ..... H01R 13/627

[52] U.S. Cl. ..... 439/353; 439/372

[58] Field of Search ..... 439/345, 350, 353, 354, 439/355, 357, 358, 372

[56] References Cited

U.S. PATENT DOCUMENTS

| | | | |
|---|---|---|---|
| 4,006,957 | 2/1977 | Narozny . | |
| 4,057,879 | 11/1977 | Eigenbrode | 24/230 |
| 4,070,081 | 1/1978 | Takahashi . | |
| 4,168,877 | 9/1979 | Little et al. . | |
| 4,169,647 | 10/1979 | Knowles et al. . | |
| 4,188,083 | 2/1980 | Knowles . | |
| 4,241,966 | 12/1980 | Gomez . | |
| 4,296,989 | 10/1981 | Larson et al. . | |
| 4,341,428 | 7/1982 | Hatch et al. . | |
| 4,345,813 | 8/1982 | Hatch . | |
| 4,359,257 | 11/1982 | Lopinski et al. . | |
| 4,428,637 | 1/1984 | Worth . | |
| 4,431,248 | 2/1984 | Huntley et al. . | |
| 4,475,786 | 10/1984 | Root et al. . | |
| 4,496,207 | 1/1985 | Ensminger . | |
| 4,531,795 | 7/1985 | Sinclair | 439/372 |
| 4,556,270 | 12/1985 | Schutzle et al. . | |
| 4,579,408 | 4/1986 | Sasaki . | |
| 4,579,414 | 4/1986 | Caveney et al. . | |
| 4,619,493 | 10/1986 | Kikuta . | |
| 4,621,885 | 11/1986 | Szczesny et al. . | |
| 4,693,533 | 9/1987 | Szczesny et al. . | |
| 4,714,433 | 12/1987 | Rider, Jr. | 439/310 |
| 4,753,608 | 6/1988 | Yamaguchi | 439/395 |
| 4,842,542 | 6/1989 | Davis | 439/357 |
| 4,853,830 | 8/1989 | Corfits et al. | 439/372 X |
| 4,897,041 | 1/1990 | Heiney et al. | 439/404 |
| 4,932,892 | 6/1990 | Hatch | 439/395 |
| 4,938,711 | 7/1990 | Davis et al. | 439/405 |
| 5,011,425 | 4/1991 | Van Zanten et al. | 439/353 |

FOREIGN PATENT DOCUMENTS 1417088 1/1987 U.S.S.R. .

*Primary Examiner*—Daniel W. Howell
*Assistant Examiner*—Khiem Nguyen
*Attorney, Agent, or Firm*—Thomas L. Peterson

[57] ABSTRACT

An electrical connector system is described, of the type that includes a latching arrangement for releasably holding a cover of a first connector to a second connector, which includes a pivoting latch that is resiliently biased against pivoting without the use of a spring. The cover (12, FIG. 1) has a pair of latch support brackets (80, 82) that are resiliently deflectable slightly together and apart. The latch has opposite parts each lying adjacent to one of the brackets and has a trunnion received in a hole in the bracket to pivot about a pivot axis (36) thereon. Each bracket has a slot (90, FIG. 3) extending radially with respect to the pivot axis (36), and each latch part has a rib (108) partially received in a slot, with each side (110, 112) of the rib being angled from parallelism with the pivot axis. As the latch pivots, the ribs deflect the brackets apart, to provide a spring force urging the latch to pivot back.

10 Claims, 4 Drawing Sheets

FIG. 4
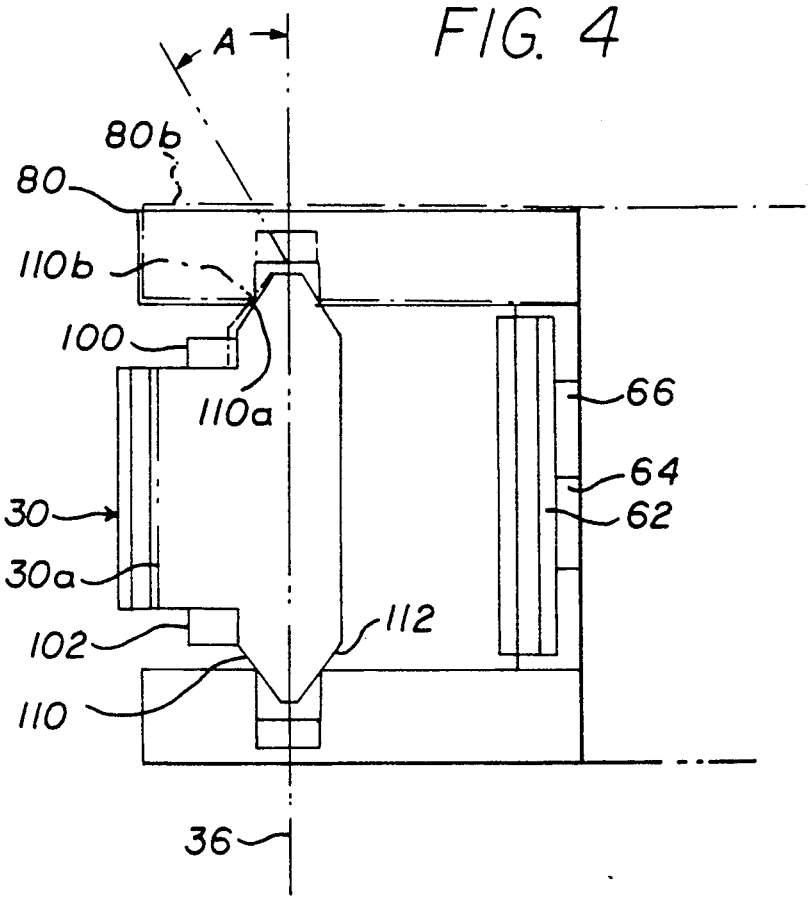
FIG. 6
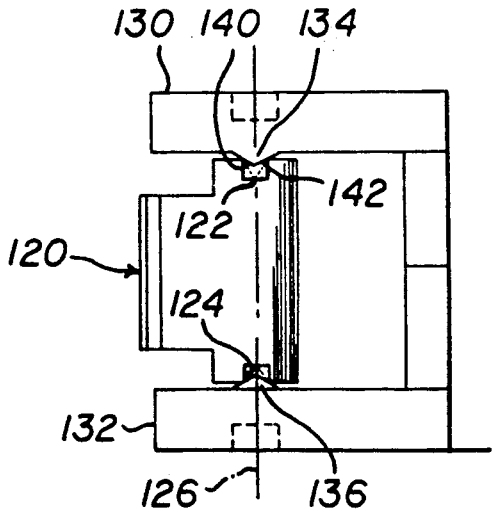
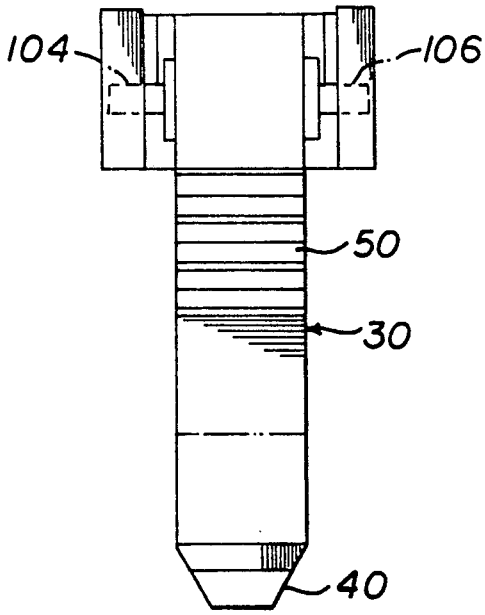
FIG. 5

CONNECTOR LATCHING ARRANGEMENT

BACKGROUND OF THE INVENTION

Some connectors include a plurality of parts that must be snapped together, with at least two of the parts being releasable. One example is in an IDC (insulation displacement contact) first connector having rows of IDC contacts, and a cover which can press a ribbon cable into the contacts and which locks to the first connector. Thereafter, a receptacle unit formed by the first connector and cover with the cable therebetween, is inserted into a second connector in the form of a header mounted on a circuit board. The receptacle unit is releasably latched to the second one to complete the system. A pair of latches that are pivotally mounted on the cover and that releasably engage strikes on the second connector, must be biased towards a latched condition, but be deflectable to enable later release from the strike. While a spring can be used, the additional space required for the spring and the additional cost for the spring and provisions for mounting it, increase the cost of the connector. U.S. Pat. No. 4,842,542 describes a latching system which includes latches formed of bent wire with wire parts forming leaf springs that urge the latches toward a latched position. The latches formed of bent wire may not be as reliable as thicker latches such as those molded from plastic. A sturdy latch such as an injection molded type, which could be pivotally mounted and biased towards a quiescent position without the need for a separate coil or leaf spring or the like, would be of considerable value.

SUMMARY OF THE INVENTION

In accordance with one embodiment of the present invention, an electrical connector is provided of the type that includes at least two members such as a connector and cover which are to be releasably held together by a pivoting latch, which includes means for biasing the latch toward a quiescent latch position without the need for a separate coil or leaf spring or the like. The cover on which the latch is pivotally mounted, includes a pair of latch support brackets spaced apart along the pivot axis of the latch, with the latch having a pair of trunnions each received in a hole in one of the brackets. Each of the brackets has a slot extending substantially radially to the pivot axis, and each side or part of the latch has a rib lying partially in the slot. The sides of the rib, or of the slot, are angled from parallelism with the pivot axis, when viewed radially along the slot, so pivoting of the latch causes the angled sides to resiliently press the brackets apart to resiliently resist pivoting of the latch.

The slot can lie either in a bracket or in a side of the latch, and the angled sides can lie either on the walls of the slot or on the sides of the rib.

The connector has a strike which is engaged by a latch block of the latch. The base has an end wall with a gap wide enough to receive the latch block. The latch has a push pad lying largely between the pivot axis and the latch block, so pushing of the pad causes the latch block to move into the gap at the end of the connector.

The novel features of the invention are set forth with particularity in the appended claims. The invention will be best understood from the following description when read in conjunction with the accompanying drawings.

BRIEF DESCRIPTION OF THE DRAWINGS

FIG. 4 is a plan view of the cover of FIG. 3, in an assembled configuration.

FIG. 5 is an end elevation view of the cover and latch of FIG. 3.

FIG. 6 is a partial plan view of a cover constructed in accordance with another embodiment of the invention.

DESCRIPTION OF THE PREFERRED EMBODIMENTS

Figure 1:
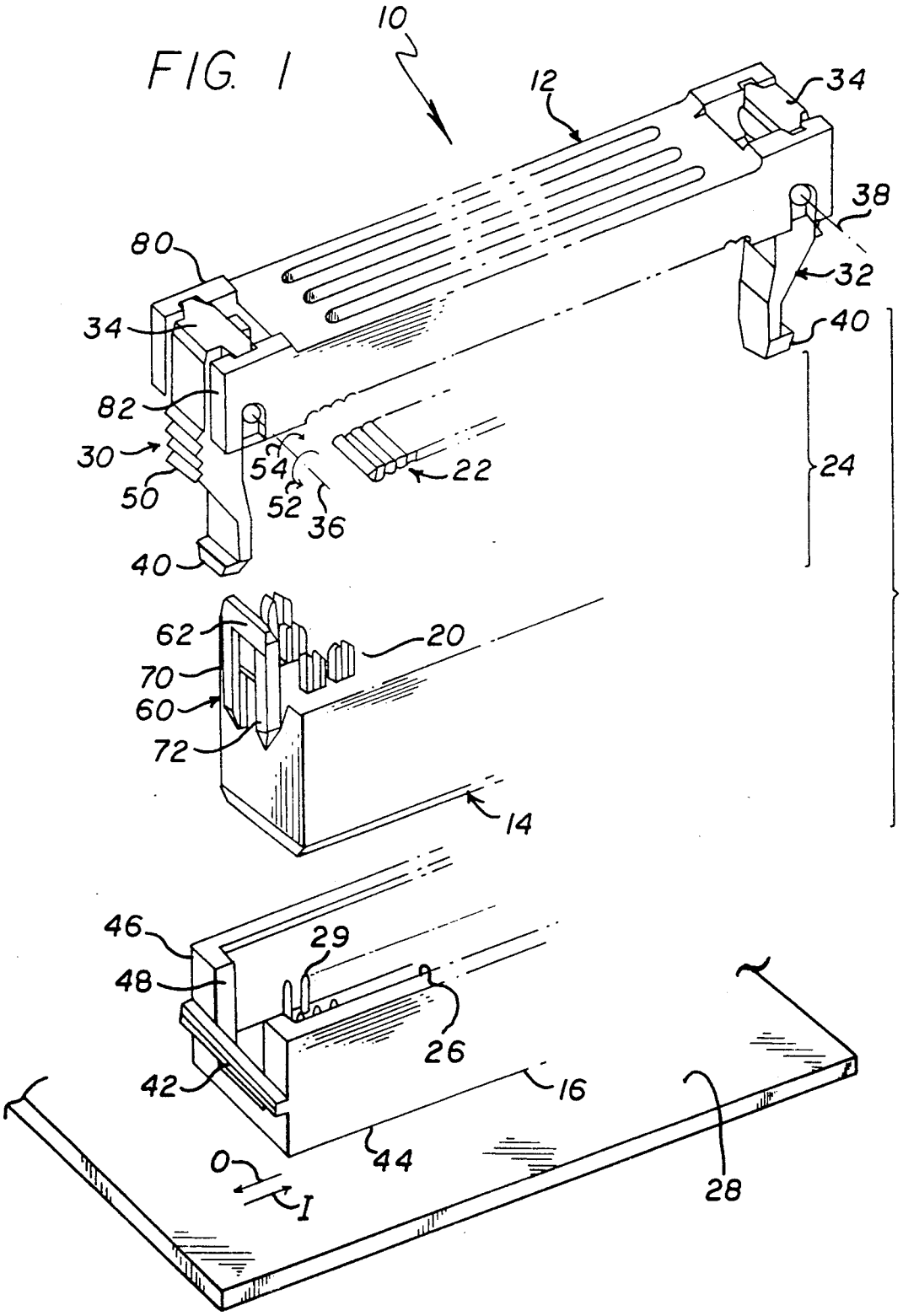
FIG. 1 is a partial exploded isometric view of an electrical connector system constructed in accordance with the present invention.

FIG. 1 illustrates an electrical connector 10 which includes a cover 12, a first connector 14, and a second connector 16 which can all be snapped and latched together. The first connector device or connector 14 includes rows of insulation displacement contacts 20 which can connect to conductors of a ribbon cable 22. The cover 12 is designed to be initially held in an upward position over the first connector 14 so the ribbon cable can be installed between them. The cover then can be pressed down to be locked in a fully installed position, wherein it presses the cable against the contacts 20. After the cover and first connector are locked together, the receptacle unit 24 formed by the combination of cover and first connector can be installed in a slot 26 of the second connector 16. The second connector 16 is mounted on a circuit board 28, and may be referred to as a header or male connector (because of its pin contacts 29). A pair of latches 30, 32 lying at opposite ends of the cover, serve to releasably retain the receptacle unit in the second connector.

Each of the latches 30, 32 includes an upper portion 34 that is pivotally mounted on the cover about a pivot axis 36, 38. Each latch also has a latch block 40 at its lower end which can engage the second connector by moving under a strike 42 on the base. The second connector includes a housing 44 with an end wall 46 having a gap 48 therein which is wide enough to receive the latch block 40. The strike 42 lies across and outward of the gap 48, with outward and inward directions relative to an end of the connector indicated by arrows 0 and I. With the parts latched together, a person can unlatch them by pushing inwardly on push pads 50 on the latches to pivot the latches in a first direction 52 about the pivot axis, to move the latch block 40 inwardly into the gap 48 so the cover (and body attached thereto) can be lifted off the base.

Figure 2:
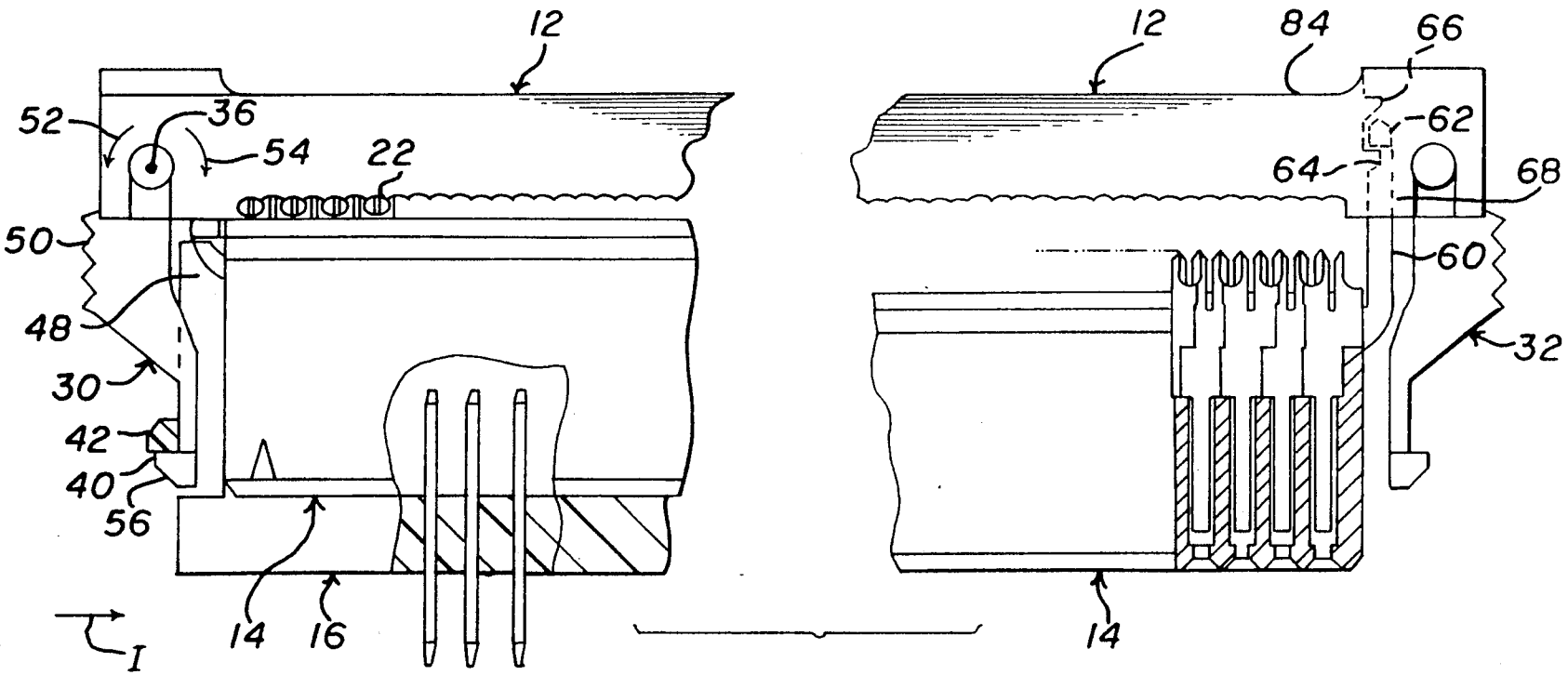
FIG. 2 is a sectional side view of the connector system of FIG. 1, with the right half showing the cover only partially installed, and with the left half showing the cover fully installed and latched in place.

When the latch is in its latched position shown at the left side of FIG. 2, the latch block 40 lies under the strike 42. FIG. 2 shows the latch block in a position of maximum engagement with the strike, wherein the latch block cannot pivot any further in a latching or second direction 54. This prevents upward lifting of the latch 30 and cover 12 on which it is mounted, and the first connector 14 lying under the cover. Any pivoting of the latch in the first direction 52 from the quiescent position of the latch shown in FIG. 2, is resiliently resisted. Pivoting in an opposite second or clockwise direction 54 is also resiliently resisted, to assure that when the latches move down a beveled lower end 56 of the latch block is in a position to be deflected behind the strike 42, until the latch block 40 can spring below the strike. The right half of FIG. 2 shows the cover 12 partially installed on the first connector 14, with a cover retainer 60 on the first connector snapped into a first position wherein a bridge 62 on the retainer has snapped over a lower retention block 64. The bridge 62 lies in a space 68 between the main cover portion 84 and the upper end of the latch 32. When the cover is pushed down further, an upper retention block 66 moves down under the bridge 62 to hold the cover in the fully installed position shown in the left half of FIG. 2. FIG. 1 shows the appearance of the retainer 60, which includes a pair of vertical arms 70, 72, with the bridge extending between the upper ends of the arms. It should be noted that while terms such as "vertical", "upper", "lower" and the like are used to aid in explaining the parts, the connector can be used in any orientation with respect to gravity.

Figure 3:
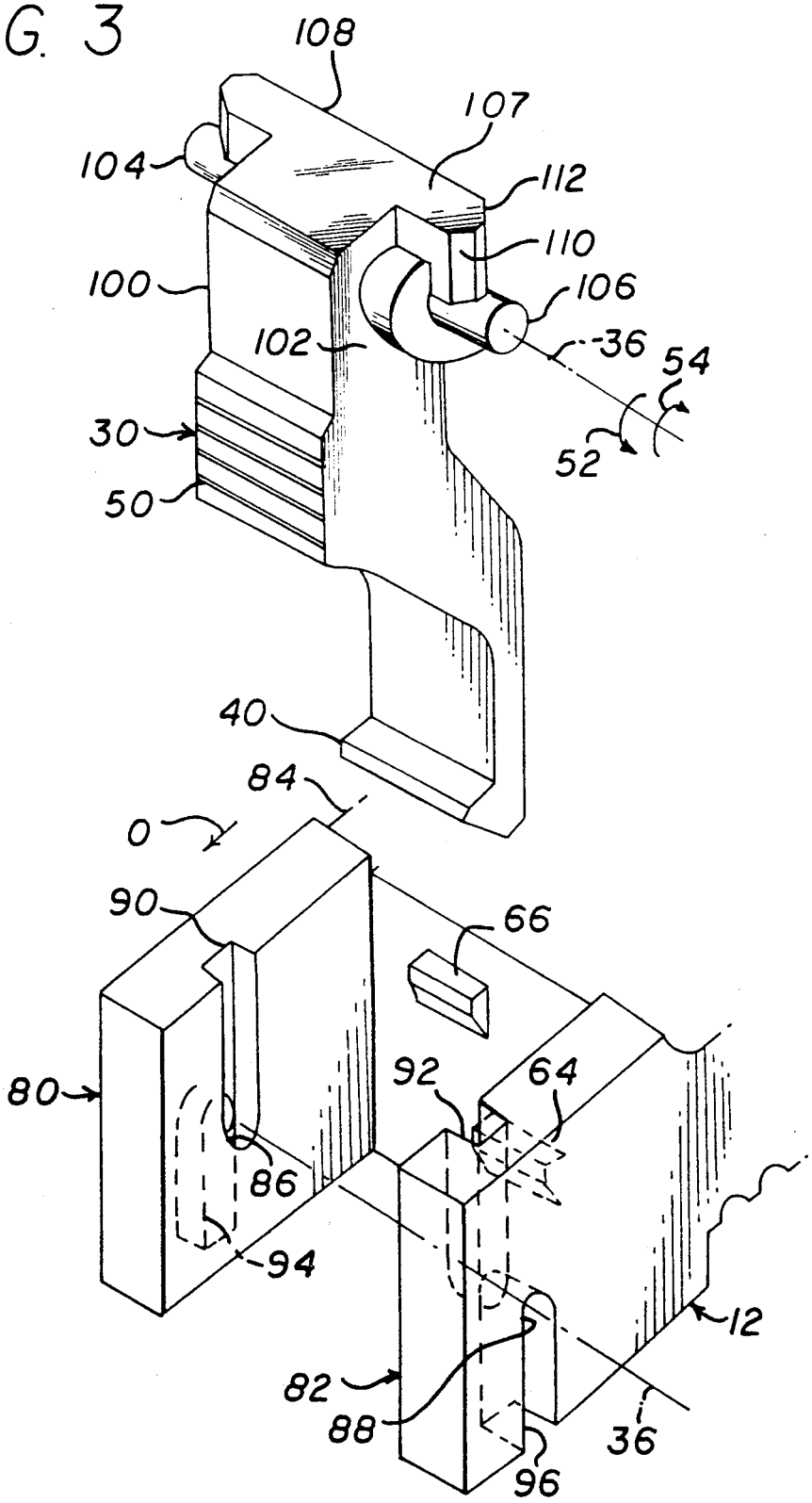
FIG. 3 is a partial exploded isometric view of the cover of FIG. 1.

As shown in FIGS. 3 and 4, the latch 30 is mounted on a pair of spaced latch support brackets 80, 82 that extend outwardly, in the direction 0 from a main portion 84 of the cover 12. The brackets 80, 82 can be resiliently deflected slightly together and apart. Each bracket has a pivot hole 86, 88 formed by a vertical slot 90, 92 extending down from the upper edge of the bracket in the facing bracket faces, and by a pair of upwardly extending slots 94, 96 that extend upwardly from the lower edges of the brackets in the outside faces of the brackets. The slots have rounded ends that overlap to form the through holes 86, 88.

The latch 30 has a pair of opposite sides 100, 102 that each has a trunnion 104, 106 that is pivotally received in one of the bracket holes 86, 88. The latch also has a pair of ribs 107, 108 that are each partially received in one of the slots 90, 92 of a bracket. Each rib has a pair of opposite rib sides including an outer side 110 and an inner side 112. Each rib side is angled or inclined from the pivot axis 36 by an angle A (FIG. 4) such as 45°, and preferably between about 30° and 70° to respectively prevent binding and to obtain significant bracket separation. As a result of such incline, when the latch pivots in the first direction 52, a point 110*a* at the top of the rib, moves to the position 110*b* and deflects a corresponding bracket such as 80 to the deflected position 80*b*. The brackets are resiliently biased towards each other, and urge the pivoted latch to pivot back to its quiescent position wherein the rib extends vertically. Similarly, the rib side 112 will spread apart the brackets if the latch turns in the second direction 54, to thereby keep the bracket biased towards the quiescent position shown in the left side in FIG. 2. Thus, while the latch can pivot in either direction about its pivot axis 36, it is biased away from pivoting in either direction, without the need for coil or leaf spring or the like. This enables the latch and support brackets to be formed of injection molded plastic, and avoids the need for separate metal parts. It is desirable that the brackets be slightly deflected apart even when the latch is in the quiescent position, to resist even slight pivoting of the latch.

FIG. 6 illustrates another embodiment of the invention, wherein a latch 120 has a pair of slots 122, 124 extending radially to an axis of pivoting 126 of the latch on a pair of latch support brackets 130, 132. Each bracket has a rib 134, 136 that is received in the slot, with each rib having a pair of opposite sides 140, 142 that are each angled from parallelism with the pivot axis 126, as viewed along the slot toward the pivot axis. It may be noted that it is possible to angle the sides of the slot such as 122 from parallelism with the pivot axis 126, and leave the sides of the rib so they are angled or not angled from the pivot axis (as seen in the top view of FIG. 6).

Referring to the left side of FIG. 2, it was described that the latch 30 can be disengaged from the strike 42 by pressing on the push pad 50 to pivot the latch block 40 inwardly, in the direction I into the gap 48 in the base. The fact that the push pad 50 lies substantially between the pivot axis 36 and the latch block 40, or in other words below the pivot axis, avoids the need for the latch to have a tab extending upwardly from the top of the cover 12, so that the cover 12 can have a low fully installed height. Also, no space has to be left outward of the strike 42 at the lower part of the base 16, to provide room for outward movement of a latch block.

While the cover 12 can be of the construction illustrated to hold down a ribbon cable, the term "cover" applies to any device which attaches to a connector.

Thus, the invention provides a latching system for an electrical connector, which minimizes the number of parts and avoids the need for metal coil or leaf springs or the like. The latching system includes a latch pivotally mounted on a pair of spaced brackets extending from a main portion of a cover, with the brackets being slightly deflectable together and apart. Each bracket has a slot extending substantially radially from the axis of pivoting of the latch, and each side or part of the latch has a rib extending into the slot. The sides of the rib, and especially the outer side thereof, are angled from parallelism with the pivot axis, as viewed along the slot toward the pivot axis. As a result, when the latch pivots, the inclined sides of the ribs press the brackets to resiliently separate them, and thereby urge the latch to pivot back to its initial quiescent position. The slots can be formed in the latch and the ribs in the brackets, and the sides of the slot or of the ribs can be beveled to provide the spring action. The second connector, which has a strike engaged by a latch block of the latch, preferably has a gap which receives the bottom of the latch. The latch has a push pad lying largely between the pivot axis and the latch block, as opposed to lying on the opposite side of (and above) the pivot axis, so the latch does not have to extend above the cover.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. An electrical connector apparatus which includes a connector, a cover which is releasably held over said connector, and a latch pivotally mounted about a pivot axis on said cover, said latch having a latch block and said connector having a strike which is engaged by said latch block to prevent separation of said cover and connector, said latch being pivotable in a second direction to a position of maximum engagement with said strike and being pivotable in a first direction to disengage from said strike and allow separation of said cover and connector, said cover having a pair of spaced latch support brackets which pivotally support said latch, characterized by:

said latch support brackets which pivotally support said latch, are resiliently deflectable slightly together and apart;

of said brackets and latch, one of them has a slot extending largely radially to said axis with said slot having a pair of slot sides, and the other of them has a rib lying partially in the slot and having a pair of rib sides, with at least one of said sides being inclined so it is angled a plurality of degrees but less than 90° from parallelism with said pivot axis, so as said latch pivots in said first direction to release from said strike, said inclined side urges said support brackets to deflect apart to thereby provide a spring force urging said latch to pivot opposite to said first direction, said rib is wide enough and lies close enough to said pivot axis that at least part of said rib remains in said slot during pivoting of said latch from a position where said latch is in said position of maximum engagement to a position where said latch first disengages from said strike and allows separation of said cover and connector.

2. The apparatus described in claim 1 wherein:

said connector includes a housing with an end wall having a gap that is wide enough to receive said latch block, said strike lying across and outward of said gap, said latch having a push pad lying largely between said pivot axis and said latch block, so pressure on said pad can move said latch block inward of said strike and into said gap.

3. The apparatus described in claim 1 wherein:

said inclined rib side is angled between about 30° and 70° from parallelism with said axis.

4. The apparatus described in claim 1 wherein:

said slots each extend vertically, said pivot axis extends horizontally, and said inclined side is angled from parallelism with said axis as seen in a plan view.

5. The apparatus described in claim 1 wherein:

two of said sides that lie on opposite sides of said pivot axis are each inclined so each is angled in a different direction from parallelism with said axis, so said latch is resiliently urged against pivoting in either of two opposite directions about said pivot axis.

6. The apparatus described in claim 1 wherein:

one of said brackets forms said slot and said latch forms said rib, and the opposite sides of said rib are each angled in opposite directions from said pivot axis as viewed along said slot towards said pivot axis.

7. An electrical connector apparatus comprising:

a connector having a strike;

a cover which is releasably held over said connector, said cover having a pair of parallel and spaced latch support brackets which are resiliently deflectable slightly together and apart;

a latch having a latch block and having opposite parts each lying adjacent to one of said brackets, said latch being pivotable on said brackets about a first axis to move said latch block into a quiescent position of substantially maximum engagement with said strike and out of engagement with said strike;

each of said brackets and each of said latch parts being constructed so one has a largely radially extending slot with opposite sides and the other has a rib with opposite sides lying partially in the slot, with a pair of said opposite sides being angled in opposite directions from said pivot axis in a view taken along said slot and toward said pivot axis, and with at least portions of said ribs and slots lying close enough to said pivot axis to cause said rib portion to remain in said slot throughout pivoting of said latch block from said quiescent position to a position out of engagement with said strike which allows said cover to release from said connector.

8. The apparatus described in claim 7 wherein:

said connector includes a housing with an end wall having a gap that is wide enough to receive said latch block, said strike lying across and outward of said gap, and said latch having a push pad lying largely between said pivot axis and said latch block, so pressure on said pad can move said latch block inward of said strike.

9. The apparatus described in claim 7 including:

a connector device that lies between said connector and said cover, said connector device having an upwardly extending cover retainer;

said cover has a main cover portion with opposite ends and opposite sides, and each of said brackets extends outwardly from a different one of said opposite sides;

said retainer has a pair of spaced vertical arms with upper ends and a bridge extending between said upper ends, and said cover has at least one retention block lying substantially between said latch support brackets and inward of the upper end of said latch to leave a space therebetween for receiving upper portions of said vertical arm and said bridge, so said bridge can lie over said retention block to hold down said cover.

10. An electrical connector apparatus which includes a connector, a cover which is releasably held over said connector, and a latch pivotally mounted about a pivot axis on said cover, said latch having a latch block and said connector having a strike which is engaged by said latch block to prevent separation of said cover and connector, said latch being pivotable in a first direction to disengage from said strike and allow separation of said cover and connector, said cover having a main cover portion with opposite ends and opposite sides and a pair of spaced latch support brackets which extend outwardly from a different one of said opposite sides and which pivotally support said latch, characterized by:

said latch support brackets are resiliently deflectable sightly together and apart;

of said brackets and latch, one of them has a slot extending largely radially to said axis with said slot having a pair of slot sides, and the other of them has a rib lying partially in the slot and having a pair of rib sides, with at least one of said sides being inclined so it is angled a plurality of degrees but less than 90° from parallelism with said pivot axis, so as said latch pivots in said first direction to release from said strike, said inclined side urges said support brackets to deflect apart to thereby provide a spring force urging said latch to pivot opposite to said first direction;

a connector device that lies between said connector and said cover, said connector device having an upwardly extending cover retainer;

said retainer has a pair of spaced vertical arms with upper ends and a bridge extending between said upper ends, and said cover has at least one retention block lying substantially between said latch support brackets and inward of the upper end of said latch to leave a space therebetween for receiving upper portions of said vertical arm and said bridge, so said bridge can lie over said retention block to hold down said cover.

* * * * *